US008393509B2

(12) United States Patent
Greg

(10) Patent No.: US 8,393,509 B2
(45) Date of Patent: Mar. 12, 2013

(54) ADAPTER FOR A BIN

(76) Inventor: Tan Greg, Harahan, LA (US)

( * ) Notice: Subject to any disclaimer, the term of this patent is extended or adjusted under 35 U.S.C. 154(b) by 425 days.

(21) Appl. No.: 12/716,504

(22) Filed: Mar. 3, 2010

(65) Prior Publication Data

US 2011/0215128 A1 Sep. 8, 2011

(51) Int. Cl.
*B26F 3/02* (2006.01)

(52) U.S. Cl. ..... 225/93; 225/39; 225/46; 225/34; 221/34; 221/45

(58) Field of Classification Search ..... 225/39, 225/106, 42, 54, 93, 47, 96, 34, 46; 248/674, 248/95, 97, 98, 126, 346.03; 206/389, 394, 206/391, 557, 558, 561; 221/22, 26, 124, 221/130; 222/165, 180
See application file for complete search history.

(56) References Cited

U.S. PATENT DOCUMENTS

| | | | | |
|---|---|---|---|---|
| 680,381 | A * | 8/1901 | Inman | 248/97 |
| 3,494,518 | A * | 2/1970 | Goss | 225/34 |
| 5,261,585 | A * | 11/1993 | Simhaee | 225/47 |
| 5,558,262 | A * | 9/1996 | Simhaee | 225/106 |
| 5,573,168 | A * | 11/1996 | Kannankeril et al. | 225/106 |
| 5,944,280 | A * | 8/1999 | Dimitri | 242/594.2 |
| 6,015,125 | A * | 1/2000 | Fischer | 248/231.9 |
| 6,230,953 | B1 | 5/2001 | Simhaee | |
| 6,267,322 | B1 * | 7/2001 | Harmathy | 242/595 |
| 6,446,811 | B1 | 9/2002 | Wilfong, Jr. | |
| 6,481,594 | B1 * | 11/2002 | Yeh et al. | 221/63 |
| 6,488,222 | B1 | 12/2002 | West et al. | |
| 6,561,403 | B1 * | 5/2003 | Kannankeril et al. | 225/96 |
| 6,685,075 | B1 | 2/2004 | Kannankeril | |
| 7,128,251 | B1 * | 10/2006 | Galle | 225/2 |
| 7,178,707 | B1 * | 2/2007 | Bokina | 225/38 |
| 7,270,256 | B2 * | 9/2007 | Daniels | 225/93 |
| 7,424,963 | B2 * | 9/2008 | Daniels | 225/93 |
| 7,591,405 | B2 | 9/2009 | Daniels | |
| 2002/0113109 | A1 * | 8/2002 | Gracyalny et al. | 225/5 |

(Continued)

FOREIGN PATENT DOCUMENTS

| | | | |
|---|---|---|---|
| JP | 08026353 A | * | 1/1996 |
| WO | WO 9622043 A1 | * | 7/1996 |

OTHER PUBLICATIONS

The Marco Company: Recessed Bag Holder for Orchard Bins http://www.marcocompany.com/products/details.php?id=186.*

*Primary Examiner* — Stephen Choi
*Assistant Examiner* — Brendan Ayer
(74) *Attorney, Agent, or Firm* — David A. Belasco; Belasco Jacobs & Townsley, LLP

(57) ABSTRACT

An adapter for a support enclosure bin for a roll of thermoplastic bags is described. The bin has a half round cylindrical wall, first and second vertical side walls attached to a supporting rim. The rim has spaced apertures for mounting the bin to a surface that has an opening that permits passage of outer surfaces of the walls but not the rim. The side walls have integral channels that provide support for a rod for a wide roll of bags. The adapter includes first and second bag dispensers for vertically folded coreless roll mounted bags. Each of the dispensers has first and second side panels that are attached together with a connecting link that aligns the front edges and bottom edges of the dispensers. First and second axles are mounted adjacent the outer side panels of the dispensers with positioning wheels that engage the integral channels of the bin.

10 Claims, 10 Drawing Sheets

U.S. PATENT DOCUMENTS

2004/0007607 A1* 1/2004 Daniels ..... 225/93
2005/0035135 A1* 2/2005 Sasian ..... 221/70
2005/0098600 A1 5/2005 Yeh et al.
2006/0266762 A1* 11/2006 Andrews et al. ..... 221/45
2007/0063626 A1* 3/2007 Scott ..... 312/334.7
2008/0128465 A1* 6/2008 Wilfong ..... 225/106
2010/0089940 A1* 4/2010 Serfaty ..... 221/34
2010/0193539 A1* 8/2010 Fathi ..... 221/45

* cited by examiner

ADAPTER FOR A BIN

FIELD OF INVENTION

This invention relates to the field of plastic bag storage and dispensing and more specifically to multiple produce bag dispensers adapted to be removably installed in standardized plastic bins mounted in existing produce department counter, walls and other fixtures.

BACKGROUND OF THE INVENTION

In supermarkets and grocery stores space in the produce department is usually at a premium. It is desirable to use as much of the space available as possible for the display of produce. However, certain facilities must be provided to the store's customers for efficient produce sales. One such facility is the provision of convenient produce bags that may be conveniently used by the customers to collect the produce that they wish to purchase. Ideally, the store would like to provide simple to use produce bag dispensers that are easy to maintain, hold a large quantity of bags of a sufficient size and which do not require frequent servicing. Grocery stores would like to use space for the produce bag dispensers that is not readily usable for the display of produce. It is most convenient to display produce on angled, substantially horizontal shelves. Vertical surfaces, such as the walls of display stands and shelves are good locations to position bag dispensers as such surfaces are not readily usable for produce display. Toward this end, some supermarket chains have developed standardized plastic bins that are installed into vertical and some horizontal surfaces. These bins are designed to accommodate a horizontal rod on which a large roll of produce bags is rotatably suspended. The present invention makes use of these standardized bins to make available a larger store of produce bags to the shopping customer.

A number of dispensing devices and produce bags have been designed to efficiently provide produce bags to shopping customers.

U.S. Pat. No. 7,591,405, issued to Daniels, discloses a wire frame plastic bag dispenser includes an angled lower bag roll support urging perforated, rolled plastic bags toward a bag roll restraining element attached to the frame. A constraining movement element prevents lateral movement of the bag roll. A perforation parting means separates bags as they are pulled from the roll. The bags may be folded along at least one vertical axis to form a more compact bag roll and may have a chisel cut in the perforation to aid in separation by the perforation parting means. The frame includes four corners each of approximately 90 degrees, has a C shape in a horizontal plane, and includes a dispensing end, a back end, and two sides. The lower bag roll support includes a proximal end attached to the back end and extends downwardly to a distal end. The perforation parting means may be located outwardly from the dispensing end of the frame.

U.S. Pat. No. 6,685,075, issued to Kannankeril is directed to a dispenser for serially dispensing plastic bags from a wound roll of plastic bags. The dispenser includes a support member which is attachable to a support surface, a pivotable arm that can pivot between a roll-loading position and bag-dispensing positions, a braking surface to prevent freewheeling, a mechanism to prevent axial movement of the roll of bags on the pivotable arm, and a tongue positioned to engage an opening between bags while the bags are dispensed. A dispensing system combines the dispenser with a roll of plastic bags having an axial passageway through the center of the roll. The dispenser can dispense a wound roll of bags that has a core or is coreless. The sides of the core can be flush with the sides of the roll of bags, can extend from the sides of the roll of bags, or can have a combination thereof.

U.S. Pat. No. 6,446,811, issued to Wilfong, Jr. illustrates a pack of self-opening serially-arranged plastic bags of the "star-seal" type defining eight superimposed wall layers in the bag. Mounting tabs form a part of top portions of each of the eight layers and are positioned in superimposed positions and each includes an aperture for mounting the tabs on a tab retaining device of a rack in a non-front-side-free manner. Each of the tabs includes a mechanism for rendering the tab detachable and providing a predetermined detaching strength. In one embodiment, each of the tabs are detachable from the rack and in another embodiment, each of the tabs are detachable from the bag. A frangible bond is formed between the rear layer and the front layer of each successive bag in the pack. This frangible bond has a predetermined strength (1) which is greater than the predetermined detaching strength of two of the tabs and (2) is weaker than the predetermined detaching strength of the remaining six tabs to allow the leading bag of the pack (when pulled by a user for removal) to disengage from the pack, while (before disengagement) pulling the succeeding bag in the pack to cause detaching of the two leading of the tabs for self-opening of the succeeding bag.

U.S. Patent Application No. 2005/0098600, published for Yeh, et al. disclose a streamlined folded T-shirt style produce bag includes: (a) a front panel, (b) a rear panel (c) two front gusset panels, (d) two rear gusset panels, (e) each front panel also joined to a respective one of the rear gusset panels at the second side edge; (f) each of the front and rear gusset panels being folded inwardly relative to the front and the rear panel; (g) the top edges of the front panel, the rear panel, the front gusset and the rear gusset panels terminating in a first perforation line, (h) an upper seam, said upper seam connecting the front panel, the rear panel, the front gusset panel and the rear gusset panels (i) the bottom edges of the front panel, the rear panel, the front gusset panels and the rear gusset panels terminating in a second perforation line, said second perforation line being perpendicular to the linear edges of the front and rear panels; (j) a lower seam, said lower seam connecting the front panel, the rear panel, the front gusset panels, and the rear gusset panels. The bags are folded inwardly from the first and second linear side edges, to establish a left fold area, a right fold area and a center area, with each of the left fold area, right fold area and center area having predetermined widths, wherein the sum of the left fold area width and the right fold area width is greater then the center area width.

U.S. Pat. No. 6,230,953, issued to Simhaee is directed to a plastic bag dispenser holds a continuous roll of bags, connected by perforated separation lines. The dispenser is provided with a tongue, which the bags are dispensed over, that engages the separation line between the bag at the end of the roll and the next bag. This begins the separation of the separation line, as well as holds the next bag behind the tongue. A finger is provided on the upstream side of the tongue, with a gap between the finger and tongue. As a bag is separated, a portion of the front edge of the next bag is held in the gap, holding the bag in position for the next user. The roll of bags rests in curved grooves in the dispenser that cause the roll to abut and frictionally engage an interior surface of the dispenser, preventing free-wheeling of the roll. The curvature of the grooves causes the component of force which creates the frictional engagement to increase as the size of the roll decreases.

U.S. Pat. No. 6,488,222, issued to West, et al. discloses a folded gusseted plastic bag has a first side gusset formed by first, second, and third longitudinal folds, a second side gusset formed by fourth, fifth, and sixth longitudinal folds, a seventh longitudinal fold being on a side of the bag containing the first, second, and third folds and forming a first folded bag flap, and an eighth longitudinal fold which is on a side of the bag containing the fourth, fifth, and sixth folds, the eighth fold forming a second folded bag flap. The folded gusseted bag also is folded into a total of at least eight contiguous plies. A roll of the folded, gusseted bags includes a continuous web of the folded, flattened bags joined along perforated severance lines. Preferably the perforated severance lines further comprise a centrally-located slit. The dispensing system utilizes the roll of folded-gusseted bags in combination with a dispenser comprising: (i) a support member for attachment to a support surface; (ii) a pair of guide channels carried by the support member for rotatably supporting the roll of plastic bags for rotation of the roll on the core; (iii) a tongue spaced apart from and carried by said support member in a predetermined position corresponding to the predetermined position of the slit in the tear line.

It is an objective of the present invention to provide a compact system for dispensing plastic produce bags that can be removably installed in standardized plastic bins provided by grocery store owners. It is a further objective to provide such a system that can store an increased number of relatively large produce bags in the standardized bin. It is a still further objective of the invention to provide a dual dispenser system that will allow for a portion of the bag supply to be restocked while allowing all of the bags to be used prior to replacement of the bag rolls. It is yet a further objective to provide such a system that can be easily fabricated from existing dispenser components. Finally, it is an objective of the present invention to provide such a system that is durable, inexpensive and simple to service.

While some of the objectives of the present invention are disclosed in the prior art, none of the inventions found include all of the requirements identified.

SUMMARY OF THE INVENTION

The present invention addresses all of the deficiencies of prior art adapter for a bin inventions and satisfies all of the objectives described above.

(1) An adapter for a bin providing the desired features may be constructed from the following components. A support enclosure bin for a roll of thermoplastic produce bags is provided. The bin has a half round cylindrical wall, first and second vertical side walls. A supporting rim is provided. The rim is located orthogonally to front edges of the side walls and upper and lower edges of the cylindrical wall. The rim has spaced apertures for mounting the bin to a surface. The surface has an opening sized and shaped to permit passage of outer surfaces of the walls but not the supporting rim. The vertical side walls have first and second integral channels. The channels provide an entry point and support for a rod. The rod is sized and shaped to support the roll of produce bags in the channels.

The adapter includes first and second bag dispensers for vertically folded roll mounted bags. Each of the dispensers has first and second side panels. A connecting link is provided. The connecting link attaches the first dispenser to the second dispenser and aligns front edges and bottom edges of the dispensers. The link locates the second side panel of the first dispenser adjacent the first side panel of the second dispenser. A first axle is provided. The first axle is mounted orthogonally adjacent the first side panel of the first dispenser and is spaced forwardly and outwardly from the first side panel. A second axle is provided. The second axle is mounted orthogonally adjacent the second side panel of the second dispenser and is spaced forwardly and outwardly from the second side panel.

First and second positioning wheels are provided. The positioning wheels are mounted to the first and second axles and located to slidably engage the first and second integral channels with the bottom edges of the dispensers located upon a lower portion of the cylindrical wall of the bin.

(2) In a variant of the invention, each of the dispensers includes a frame. A lower bag roll support is provided. A movement constraining element is provided. A bag roll restrainer is provided. A perforation parter is provided. The frame includes four corners, each of approximately 90 degrees, has a C shape in a horizontal plane, and includes a dispensing end, a back end, and two sides. The lower bag roll support includes a proximal end and a distal end. The distal end is attached to the back end of the frame and extends angularly downward from the distal end toward the proximal end. The movement constraining element is formed as the first and second side panels. The side panels are attached to the two sides of the frame. Adjacent to the proximal end of the lower bag roll support the bag roll restrainer is attached to the side panels of the frame. The perforation parter is located adjacent the proximal end.

(3) In another variant, the connecting link is a continuous element extending from the first side panel of the first dispenser to the second side panel of the second dispenser. The connecting link serves as the bag roll restrainers for the first and second dispensers.

(4) In still another variant, the first and second axles are attached to first and second ends of the connecting link.

(5) In yet another variant, each of the first and second axles further includes a right angle section leading to an extension that extends rearward from the positioning wheel. The extension terminates in a second, opposite right angle section. The second section connects to the connecting link.

(6) In a further variant, the first and second dispensers further include anti-friction elements. The elements are sized and shaped to fit over lower support elements of each of the dispensers.

(7) In still a further variant, the adapter for a bin further includes bags for use in the dispensers. The bags include first and second parallel linear side edges, a top edge and a bottom edge. The bags are joined along a perforated severance line at the top edge of a first bag and below the bottom edge of a subsequent bag. The bags are rolled about a horizontal axis to form a bag roll from which the bags are dispensed. The bag roll has a first predetermined width narrower than a distance between the side panels. When the bag roll is located within the dispenser with the first bag accessible for withdrawal from the dispenser, the bags may be serially withdrawn from the roll with each subsequent bag parted at the perforated severance line.

(8) In yet a further variant, the bags further include a chisel cut. The chisel cut penetrates the perforated severance line and is located on it so as to align with the perforation parter of the dispenser.

(9) In another variant of the invention, the perforated severance line is formed of a series of alternating cuts and spaces. At least one of the cuts is located so as to align with the perforation parter.

(10) In still another variant, each of the bags is folded along at least one axis parallel to the first and second parallel linear side edges.

(11) In yet another variant, the bin further includes a recessed compartment, the compartment is located adjacent one of the first and second vertical walls and is sized and shaped to hold bag closure ties.

(12) In a further variant, said first and second dispensers are joined at said back ends of said frames by a joining element.

(13) In still a further variant, an adapter for a bin providing the desired features may be constructed from the following components. A support enclosure bin for a roll of thermoplastic produce bags is provided. The bin has a half round cylindrical wall, first and second vertical side walls. A supporting rim is provided. The rim is located orthogonally to front edges of the side walls and upper and lower edges of the cylindrical wall. The rim has spaced apertures for mounting the bin to a surface. The surface has an opening sized and shaped to permit passage of outer surfaces of the walls but not the supporting rim. The vertical side walls have first and second integral channels. The channels provide an entry point and support for a rod. The rod is sized and shaped to support the roll of produce bags in the channels.

The adapter includes first and second bag dispensers for vertically folded roll mounted bags. Each of the dispensers has first and second side panels and mounting features for attaching the dispensers to a horizontal surface. A loading tray is provided. The loading tray has a planar, horizontal surface and at least two attachment points for attaching the first and second dispensers to the surface. The tray aligns the front edges and bottom edges of the dispensers, locating the second side panel of the first dispenser adjacent the first side panel of the second dispenser. A first axle is provided. The first axle is mounted to the loading tray orthogonally adjacent the first side panel of the first dispenser and is spaced forwardly and outwardly from the first side panel. A second axle is provided. The second axle is mounted to the loading tray orthogonally adjacent the second side panel of the second dispenser and is spaced forwardly and outwardly from the second side panel. First and second positioning wheels are provided. The positioning wheels are mounted to the first and second axles and located to slidably engage the first and second integral channels of the bin with the bottom edges of the dispensers located upon a lower portion of the cylindrical wall of the bin.

(14) In yet a further variant each of the dispensers includes a frame. A lower bag roll support is provided. A movement constraining element is provided. A bag roll restrainer is provided. A perforation parter is provided. The frame includes four corners, each of approximately 90 degrees, has a C shape in a horizontal plane, and includes a dispensing end, a back end, and two sides. The lower bag roll support includes a proximal end and a distal end. The distal end is attached to the back end of the frame and extends angularly downward from the distal end toward the proximal end. The movement constraining element is formed as the first and second side panels. The side panels are attached to the two sides of the frame. Adjacent to the proximal end of the lower bag roll support the bag roll restrainer is attached to the side panels of the frame. The perforation parter is located adjacent the proximal end.

(15) In another variant of the invention, each of the mounting features for attaching the dispensers to a horizontal surface further includes at least one horizontal plate, the plate has an aperture, the aperture is sized, shaped and located to engage one of the at least two attachment points on the horizontal surface of the loading tray.

(16) In still another variant, each of the at least two attachment points for attaching the first and second dispensers to the surface further includes a threaded shaft and a mating nut.

(17) In yet another variant, the loading tray further includes a mounting rod. The mounting rod connects the first axle to the second axle.

(18) In a further variant, the adapter for a bin further includes at least one L-shaped bracket. The bracket has a vertical portion and a horizontal portion and is mounted by the vertical portion to the lower edge of the cylindrical wall of the bin. The horizontal portion is spaced above the cylindrical wall to fit slidably over the horizontal surface of the loading tray, thereby preventing excessive movement of the adapter.

(19) In still a further variant, the adapter for a bin further includes bags for use in the dispensers. The bags include first and second parallel linear side edges, a top edge and a bottom edge. The bags are joined along a perforated severance line at the top edge of a first bag and below the bottom edge of a subsequent bag. The bags are rolled about a horizontal axis to form a bag roll from which the bags are dispensed. The bag roll has a first predetermined width narrower than a distance between the side panels. When the bag roll is located within the dispenser with the first bag accessible for withdrawal from the dispenser, the bags may be serially withdrawn from the roll with each subsequent bag parted at the perforated severance line.

(20) In yet a further variant, the bags further include a chisel cut. The chisel cut penetrates the perforated severance line and is located on it so as to align with the perforation parter of the dispenser.

(21) In another variant of the invention, the perforated severance line is formed of a series of alternating cuts and spaces. At least one of the cuts is located so as to align with the perforation parter.

(22) In still another variant, each of the bags is folded along at least one axis parallel to the first and second parallel linear side edges.

(23) In a final variant of the invention, a method of using an adapter for a bin, includes the steps of:

- providing a support enclosure bin for a roll of thermoplastic produce bags that includes:
  - a support enclosure for a roll of thermoplastic produce bags, the enclosure has a half round cylindrical wall, first and second vertical side walls;
  - a supporting rim, the rim located orthogonally to front edges of the side walls and upper and lower edges of the cylindrical wall and has spaced apertures for mounting the enclosure to a surface;
  - the surface has an opening sized and shaped to permit passage of outer surfaces of the walls but not the supporting rim;
  - the vertical side walls has first and second integral channels, the channels providing an entry point and support for a rod, the rod is sized and shaped to support the roll of produce bags in the channels;
- providing an adapter that includes:
  - first and second bag dispensers for vertically folded roll mounted bags, each of the dispensers has first and second side panels and mounting features for attaching the dispensers to a horizontal surface;
  - a loading tray, the loading tray has a planar, horizontal surface, at least two attachment points for attaching the first and second dispensers to the surface, aligning front edges and bottom edges of the dispensers, locating the second side panel of the first dispenser adjacent the first side panel of the second dispenser;
  - a first axle, the first axle is mounted to the loading tray orthogonally adjacent the first side panel of the first dispenser and is spaced forwardly and outwardly from the first side panel;

a second axle, the second axle is mounted to the loading tray orthogonally adjacent the second side panel of the second dispenser and is spaced forwardly and outwardly from the second side panel; and first and second positioning wheels, the positioning wheels are mounted to the first and second axles and located to slidably engage the first and second integral channels with the bottom edges of the dispensers located upon a lower portion of the cylindrical wall of the enclosure.

attaching the first and second dispensers to the loading tray using the mounting features and the attachment points;

inverting the loading tray;

inserting the positioning wheels into the first and second integral channels in the enclosure;

positioning the loading tray in the enclosure with the first and second dispensers facing upwardly;

securing the loading tray to the lower edge of the cylindrical wall with at least one L-shaped bracket; and inserting a roll of bags in at least one of the dispensers.

An appreciation of the other aims and objectives of the present invention and an understanding of it may be achieved by referring to the accompanying drawings and the detailed description of a preferred embodiment.

DESCRIPTION OF THE DRAWINGS

DETAILED DESCRIPTION OF THE PREFERRED EMBODIMENT (1) FIGS. 1-3 illustrate an adapter for a bin 10 providing the desired features that may be constructed from the following components. A support enclosure bin 14 for a roll of thermoplastic produce bags 18 is provided. The bin has a half round cylindrical wall 22, first 26 and second 30 vertical side walls. A supporting rim 34 is provided. The rim 34 is located orthogonally to front edges 38 of the side walls 26, 30 and upper 42 and lower 46 edges of the cylindrical wall 22. As illustrated in FIG. 1A, the rim 34 has spaced apertures 50 for mounting the bin 14 to a surface 54. The surface 54 has an opening 58 sized and shaped to permit passage of outer surfaces 62 of the walls 22, 26, 30 but not the supporting rim 34. The vertical side walls 26, 30 have first 66 and second 70 integral channels. As illustrated in FIG. 4, the channels 66, 70 provide an entry point 74 and support for a rod 78. The rod 78 is sized and shaped to support the roll of produce bags 18 in the channels 66, 70.

As illustrated in FIGS. 2, 5A, 5B and 6, the adapter 10 includes first 82 and second 86 bag dispensers for vertically folded roll mounted bags 90. Each of the dispensers 82, 86 has first 94 and second 98 side panels. A connecting link 102 is provided. The connecting link 102 attaches the first dispenser 82 to the second dispenser 86 and aligns front edges 106, 110 and bottom edges 114, 118 of the dispensers 82, 86. The link 102 locates the second side panel 98 of the first dispenser 82 adjacent the first side panel 92 of the second dispenser 86. A first axle 122 is provided. The first axle 122 is mounted orthogonally adjacent the first side panel 94 of the first dispenser 82 and is spaced forwardly and outwardly from the first side panel 94. A second axle 126 is provided. The second axle 126 is mounted orthogonally adjacent the second side panel 98 of the second dispenser 86 and is spaced forwardly and outwardly from the second side panel 98.

Figure 1:
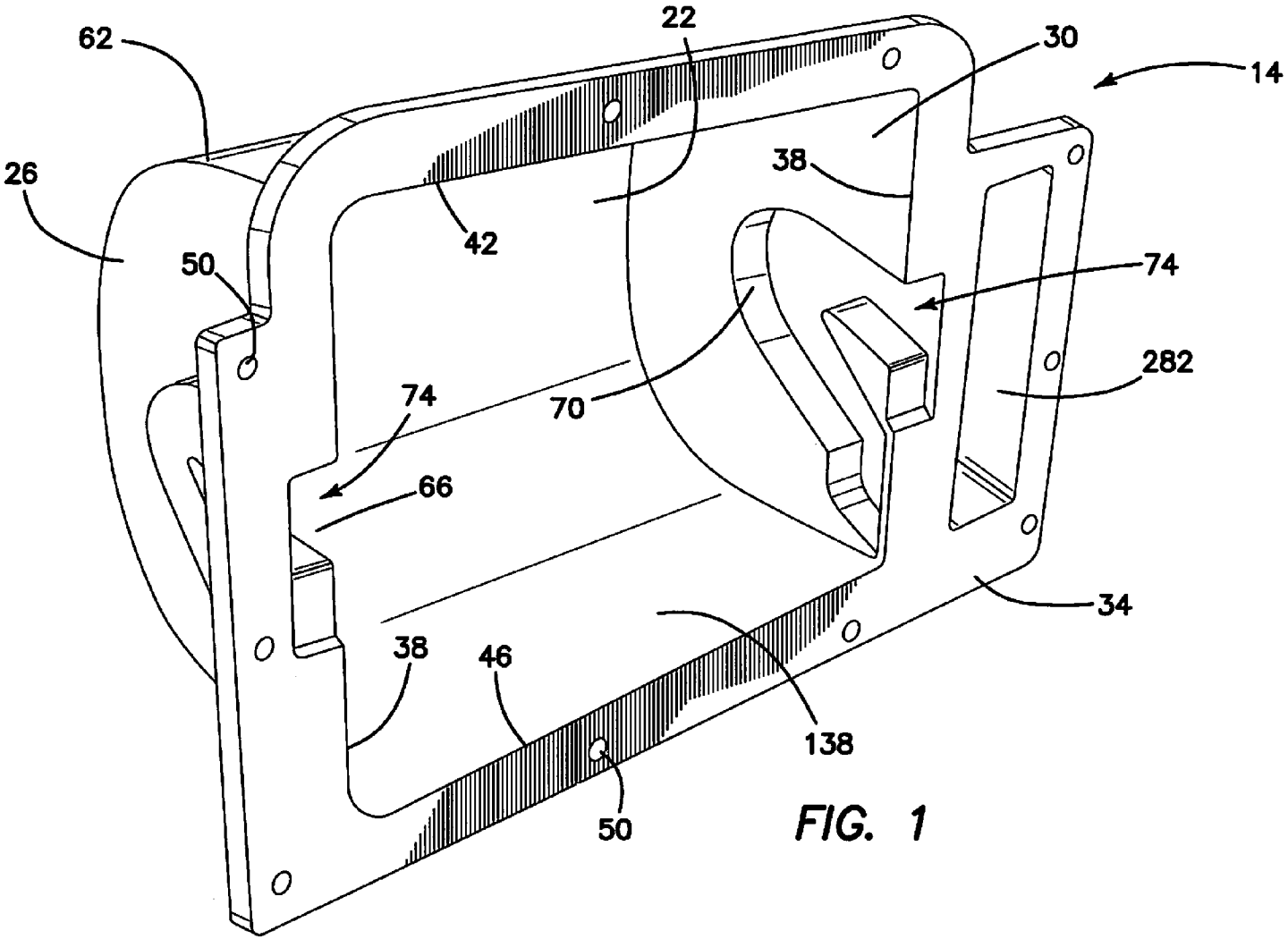
FIG. 1 PRIOR ART
FIG. 1 is a perspective view of the bin for which the adapter is designed.

First 130 and second 134 positioning wheels are provided. The positioning wheels 130, 134 are mounted to the first 122 and second 126 axles and located to slidably engage the first and second integral channels 66, 70 with the bottom edges 114, 118 of the dispensers 82, 86 located upon a lower portion 138 of the cylindrical wall 22 of the bin 14.

(2) In a variant of the invention, each of the dispensers 82, 86 includes a frame 142. A lower bag roll support 146 is provided. A movement constraining element 150 is provided. A bag roll restrainer 154 is provided. A perforation parter 158 is provided. The frame 142 includes four corners 162, each of approximately 90 degrees, and includes a dispensing end 170, a back end 174, and two sides 178, 182. The lower bag roll support 146 includes a proximal end 186 and a distal end 190. The distal end 190 is attached to the back end 174 of the frame 142 and extends angularly downward from the distal end 190 toward the proximal end 186. The movement constraining element 150 is formed as the first 94 and second 98 side panels. The side panels 94, 98 are attached to the two sides 178, 182 of the frame 142. Adjacent to the proximal end 186 of the lower bag roll support 146 the bag roll restrainer 154 is attached to the side panels 94, 98 of the frame 142. The perforation parter 158 is located adjacent the proximal end 186.

(3) In another variant, the connecting link 102 is a continuous element extending from the first side panel 94 of the first dispenser 82 to the second side panel 98 of the second dispenser 86. The connecting link 102 serves as the bag roll restrainers 154 for the first 82 and second 86 dispensers.

(4) In still another variant, the first 122 and second 126 axles are attached to first (not shown) and second 198 ends of the connecting link 102.

(5) In yet another variant, each of the first 122 and second 126 axles further includes a right angle section 202 leading to an extension 206 that extends rearward from the positioning wheel 130, 134. The extension 206 terminates in a second, opposite right angle section 210. The second section 210 connects to the connecting link 102.

(6) In a further variant, the first 82 and second 86 dispensers further include anti-friction elements 214. The elements 214 are sized and shaped to fit over lower support elements 218 of each of the dispensers 82, 86.

Figure 3:
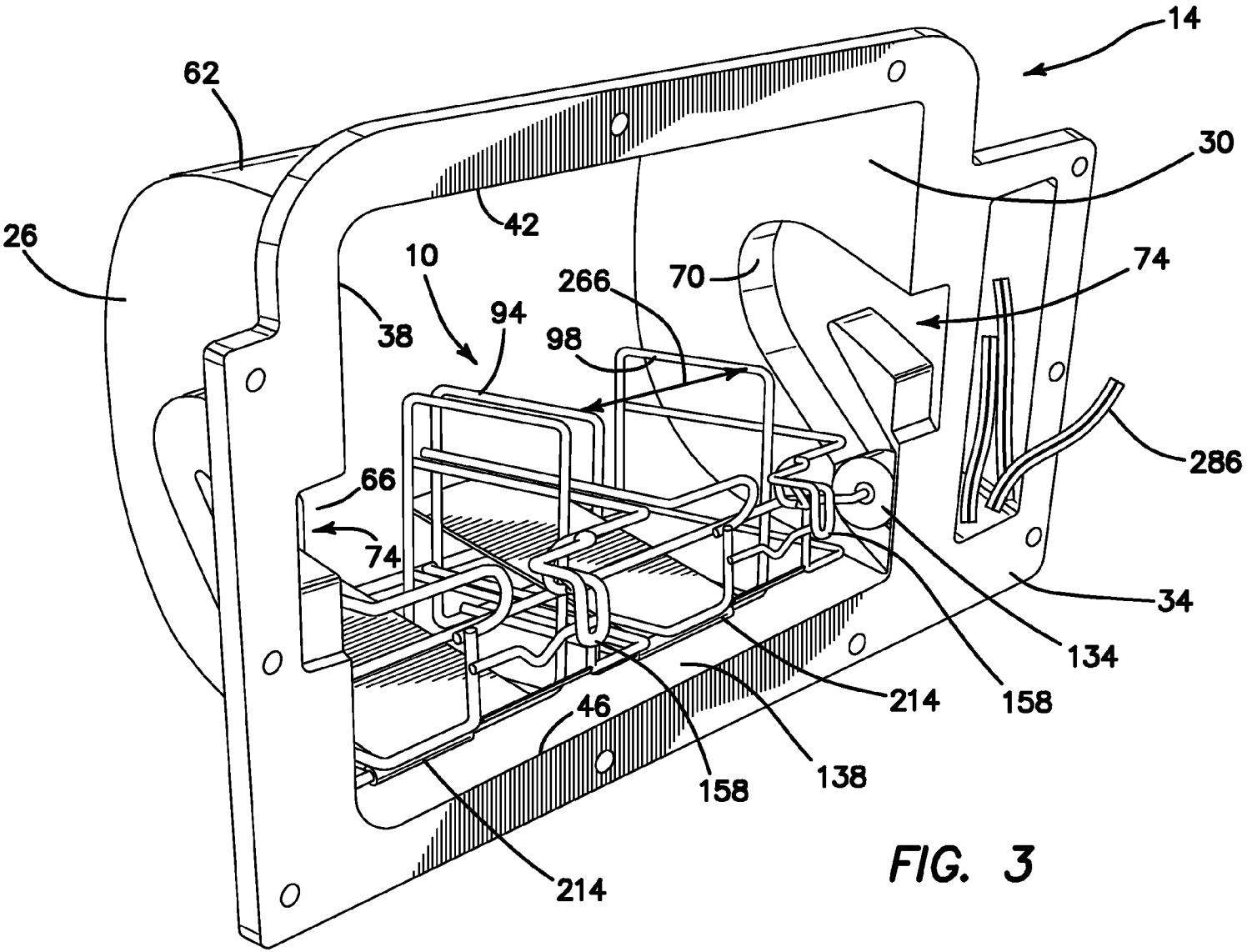
FIG. 3 is a perspective view of the adapter installed into the bin of the FIG. 1 embodiment.
Figure 5A:
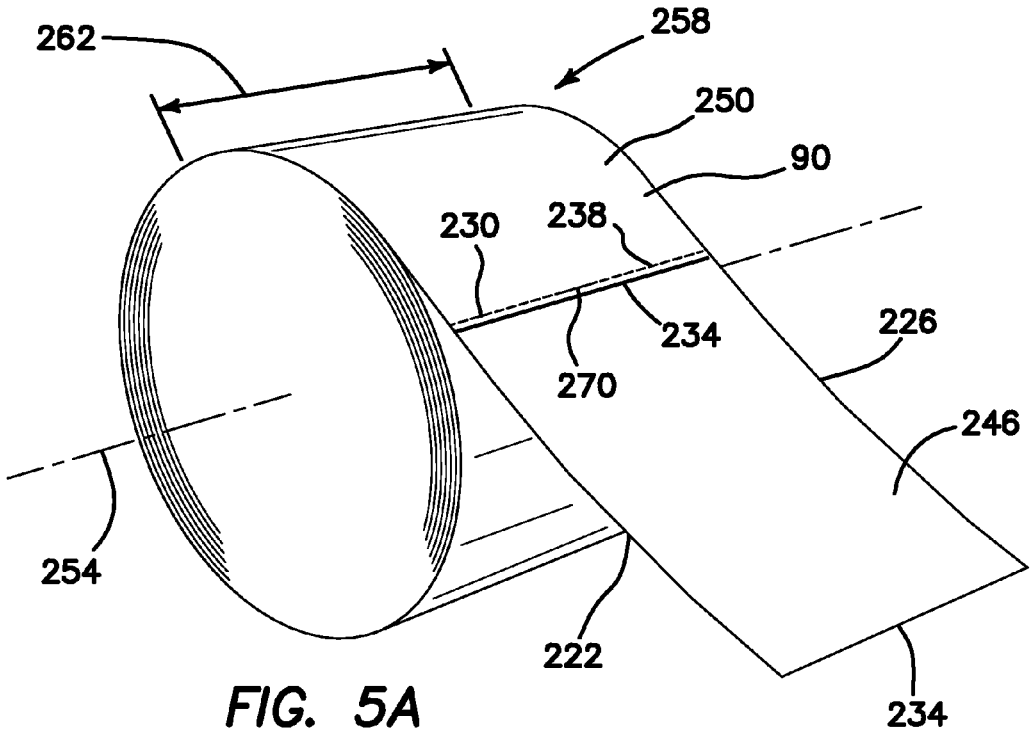
FIG. 5A is a perspective view of a roll of vertically folded bags joined by perforation lines and having a chisel cut.
Figure 5B:
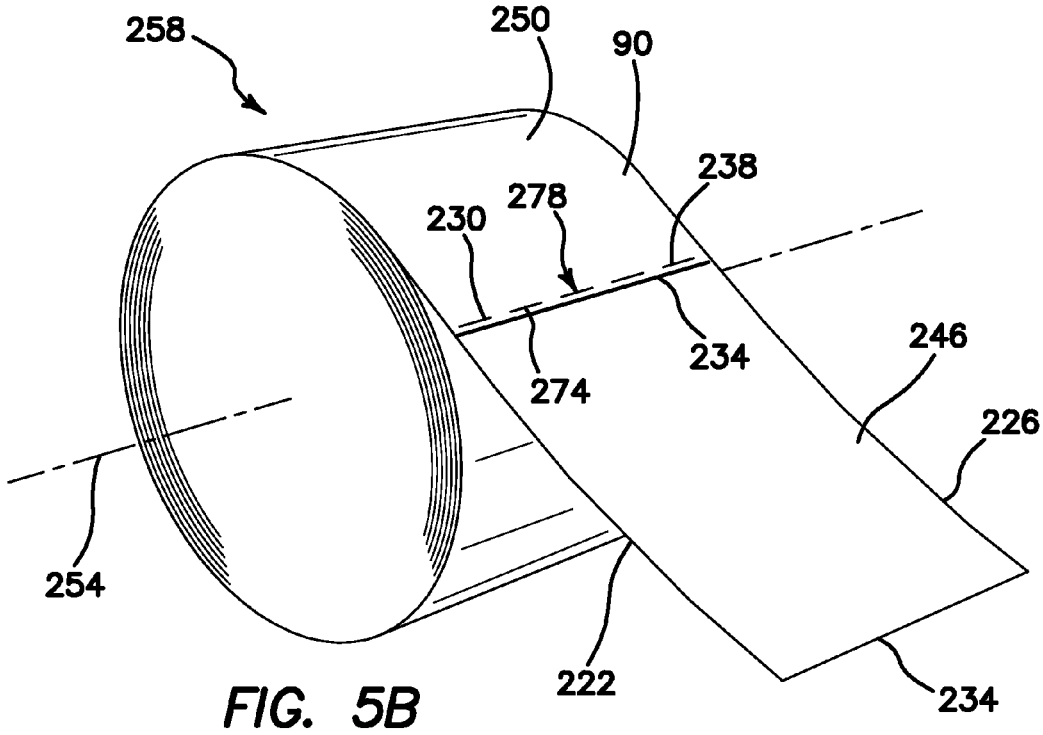
FIG. 5B is a perspective view of a roll of vertically folded bags joined by alternating cuts and spaces and having a chisel cut.

(7) In still a further variant, as illustrated in FIGS. 5A and 5B, the adapter for a bin 10 further includes bags 90 for use in the dispensers 82, 86. The bags 90 include first 222 and second 226 parallel linear side edges, a top edge 230 and a bottom edge 234. The bags 90 are joined along a perforated severance line 238 at the top edge 230 of a first bag 246 and below the bottom edge 234 of a subsequent bag 250. The bags 90 are rolled about a horizontal axis 254 to form a bag roll 258 from which the bags 90 are dispensed. The bag roll 258 has a first predetermined width 262 narrower than a distance 266 between the side panels 94, 98, as shown in FIG. 3. When the bag roll 258 is located within the dispenser 82, 86 with the first bag 246 accessible for withdrawal from the dispenser 82, 86, the bags 90 may be serially withdrawn from the roll 258 with each subsequent bag 250 parted at the perforated severance line 238, as shown in 6.

(8) In yet a further variant, as illustrated in FIG. 5A, the bags 90 further include a chisel cut 270. The chisel cut 270 penetrates the perforated severance line 238 and is located on it so as to align with the perforation parter 158 of the dispenser 82, 86.

(9) In another variant of the invention, as illustrated in FIG. 5B, the perforated severance line 238 is formed of a series of alternating cuts 274 and spaces 278. At least one of the cuts 274 is located so as to align with the perforation parter 158.

Figure 6:
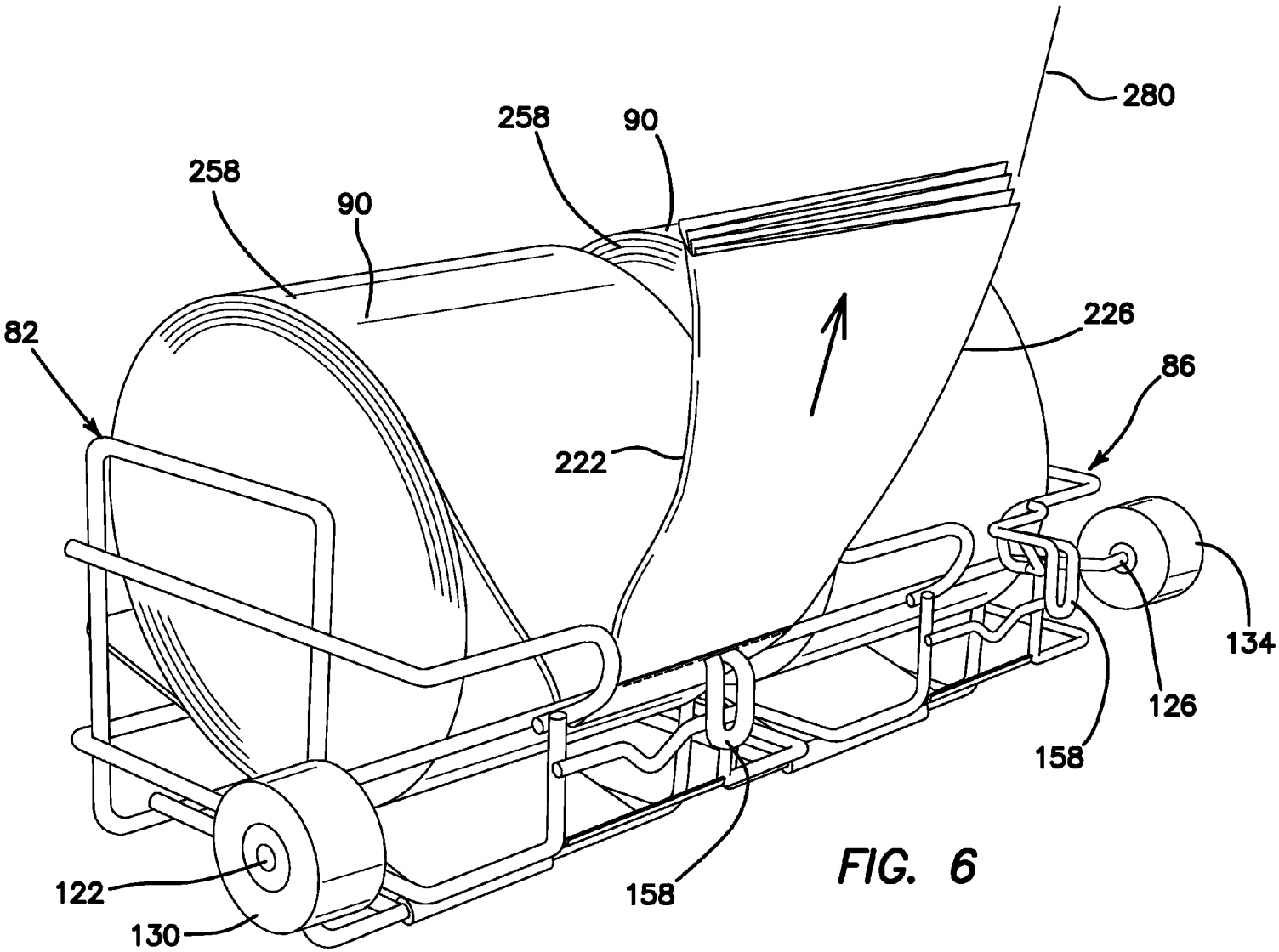
FIG. 6 is a perspective view of the FIG. 2 adapter with two of the FIG. 5A bag rolls installed.

(10) In still another variant, as illustrated in FIG. 6, each of the bags 90 is folded along at least one axis 280 parallel to the first 222 and second 226 parallel linear side edges.

(11) In yet another variant, as illustrated in FIG. 3, the bin 14 further includes a recessed compartment 282, the compartment 282 is located adjacent one of the first 26 and second 30 vertical walls and is sized and shaped to hold bag closure ties 286.

Figure 2:
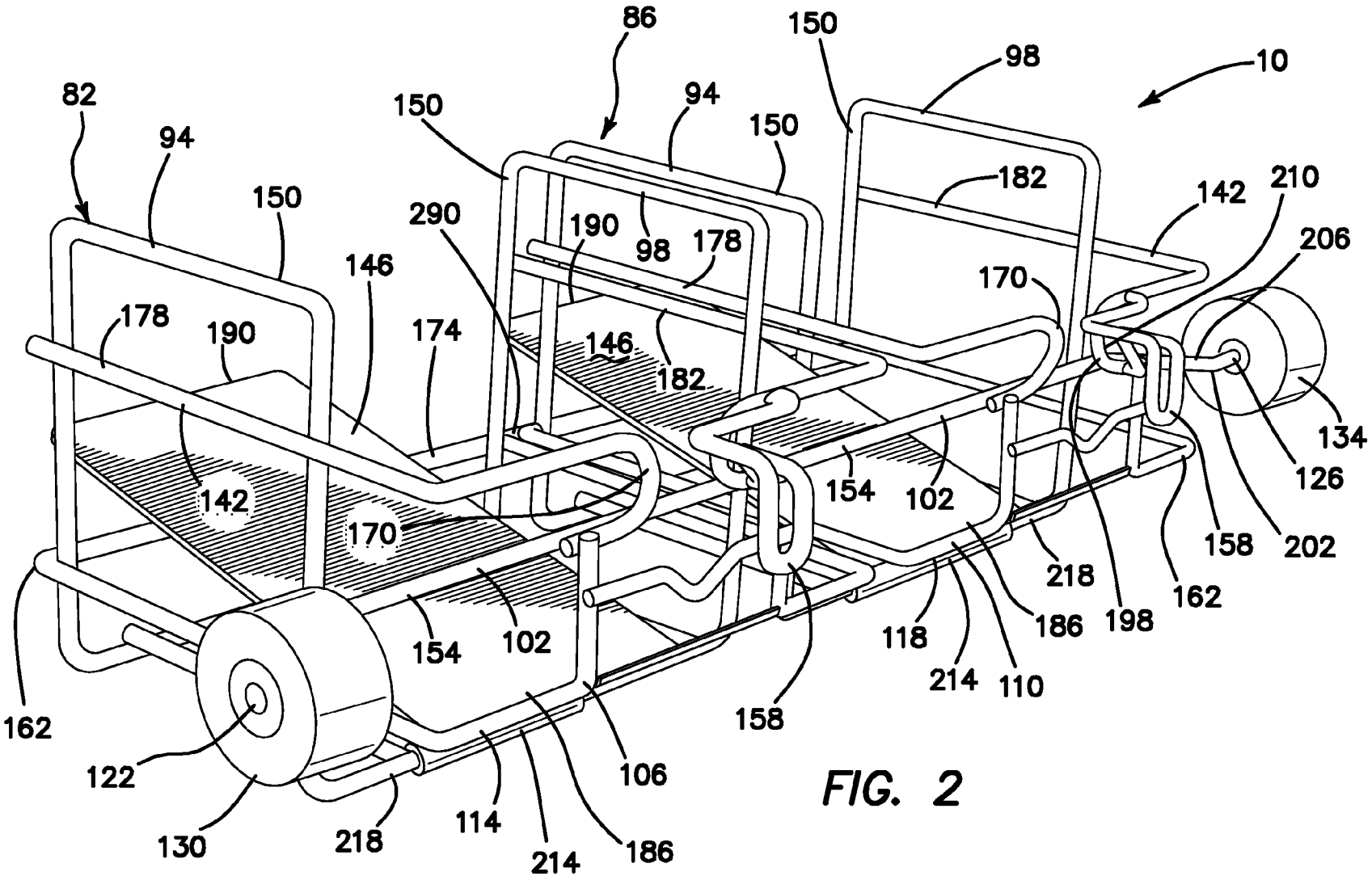
FIG. 2 is a perspective view of the adapter for the bin.

(12) In a further variant of the invention, as illustrated in FIG. 2, said first 82 and second 86 dispensers are joined at said back ends 174 of said frames 142 by a joining element 290.

Figure 1A:
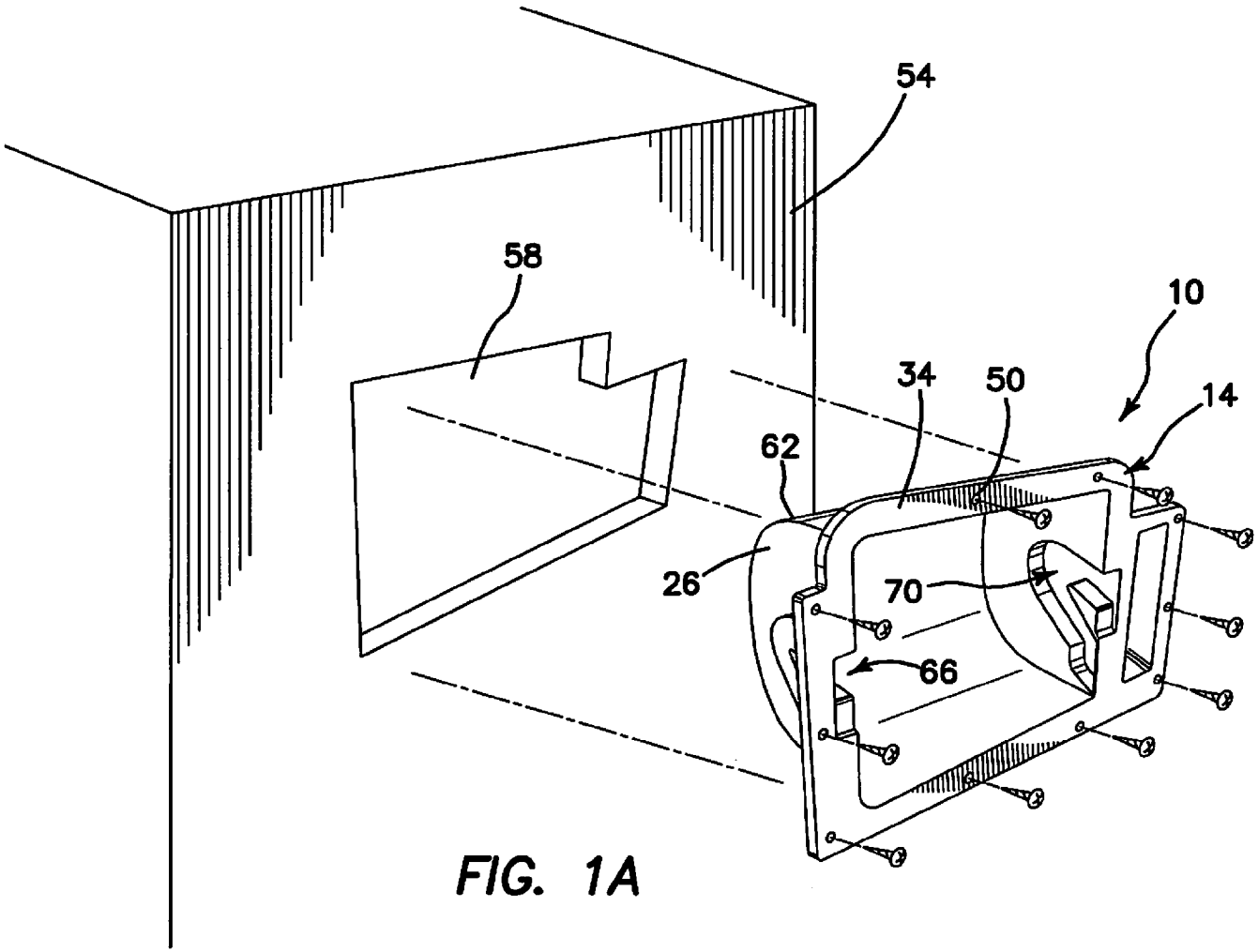
FIG. 1A PRIOR ART
FIG. 1A is a perspective view of the bin and a surface into which it is installed.
Figure 4:
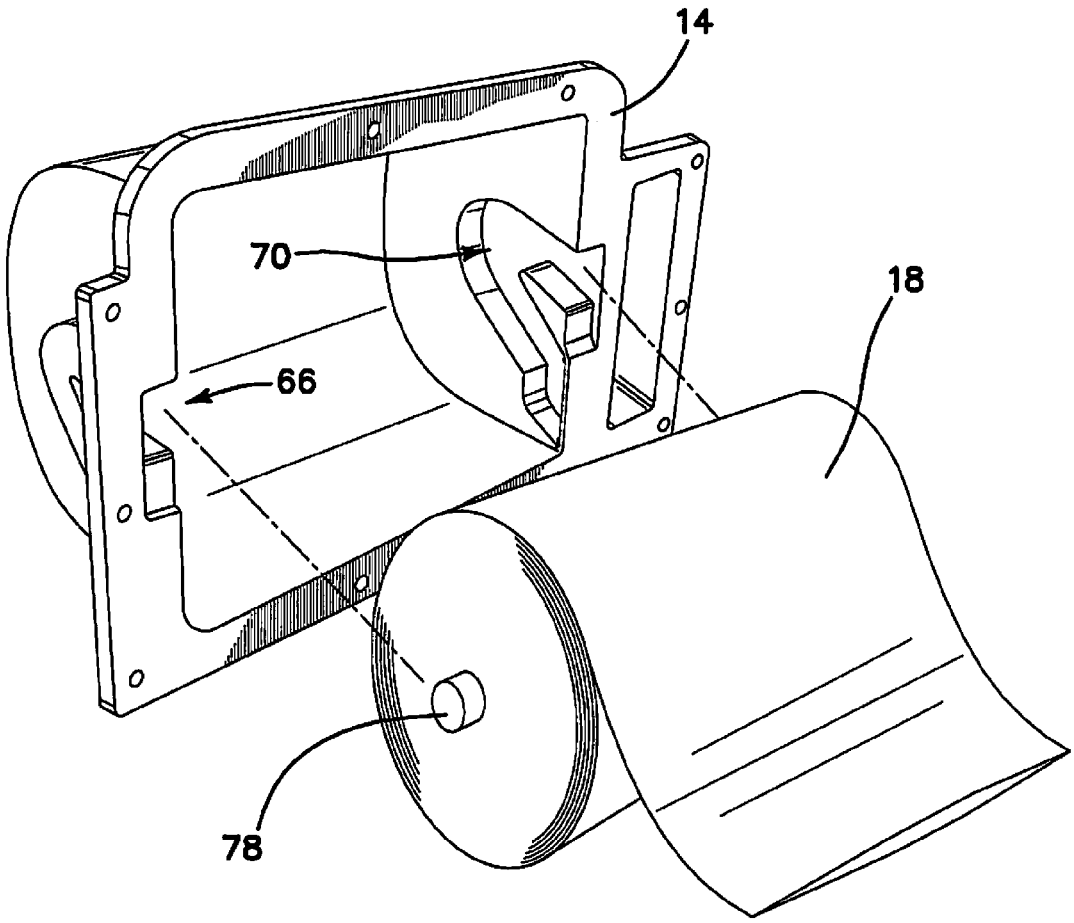
PRIOR ART FIG. 4
FIG. 4 is a perspective view of the bin with a single bag roll for installation.

(13) In still a further variant, an adapter for a bin 10 providing the desired features that may be constructed from the following components. As illustrated in FIG. 1, a support enclosure bin 14 for a roll of thermoplastic produce bags 18 is provided. The bin has a half round cylindrical wall 22, first 26 and second 30 vertical side walls. A supporting rim 34 is provided. The rim 34 is located orthogonally to front edges 38 of the side walls 26, 30 and upper 42 and lower 46 edges of the cylindrical wall 22. As illustrated in FIG. 1A, the rim 34 has spaced apertures 50 for mounting the bin 14 to a surface 54. The surface 54 has an opening 58 sized and shaped to permit passage of outer surfaces 62 of the walls 22, 26, 30 but not the supporting rim 34. The vertical side walls 26, 30 have first 66 and second 70 integral channels. As illustrated in FIG. 4, the channels 66, 70 provide an entry point 74 and support for a rod 78. The rod 78 is sized and shaped to support the roll of produce bags 18 in the channels 66, 70.

Figure 7:
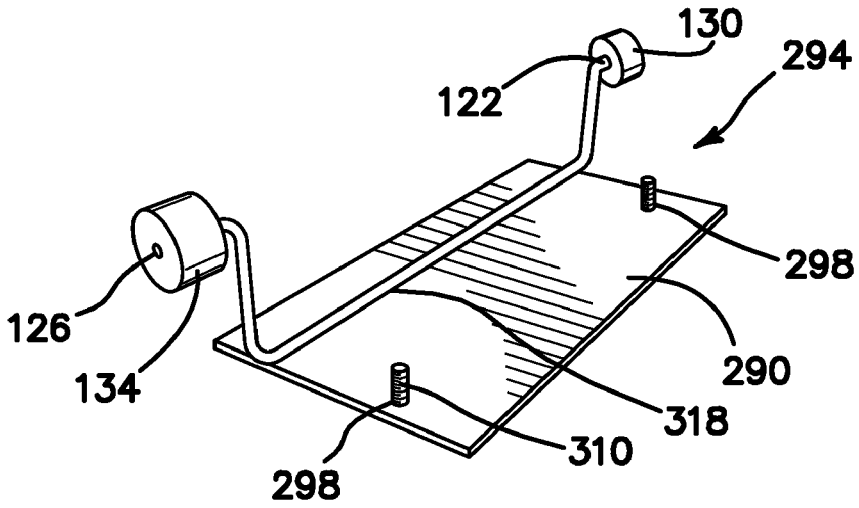
FIG. 7 is a perspective view of a loading tray for the dispensers.
Figure 9:
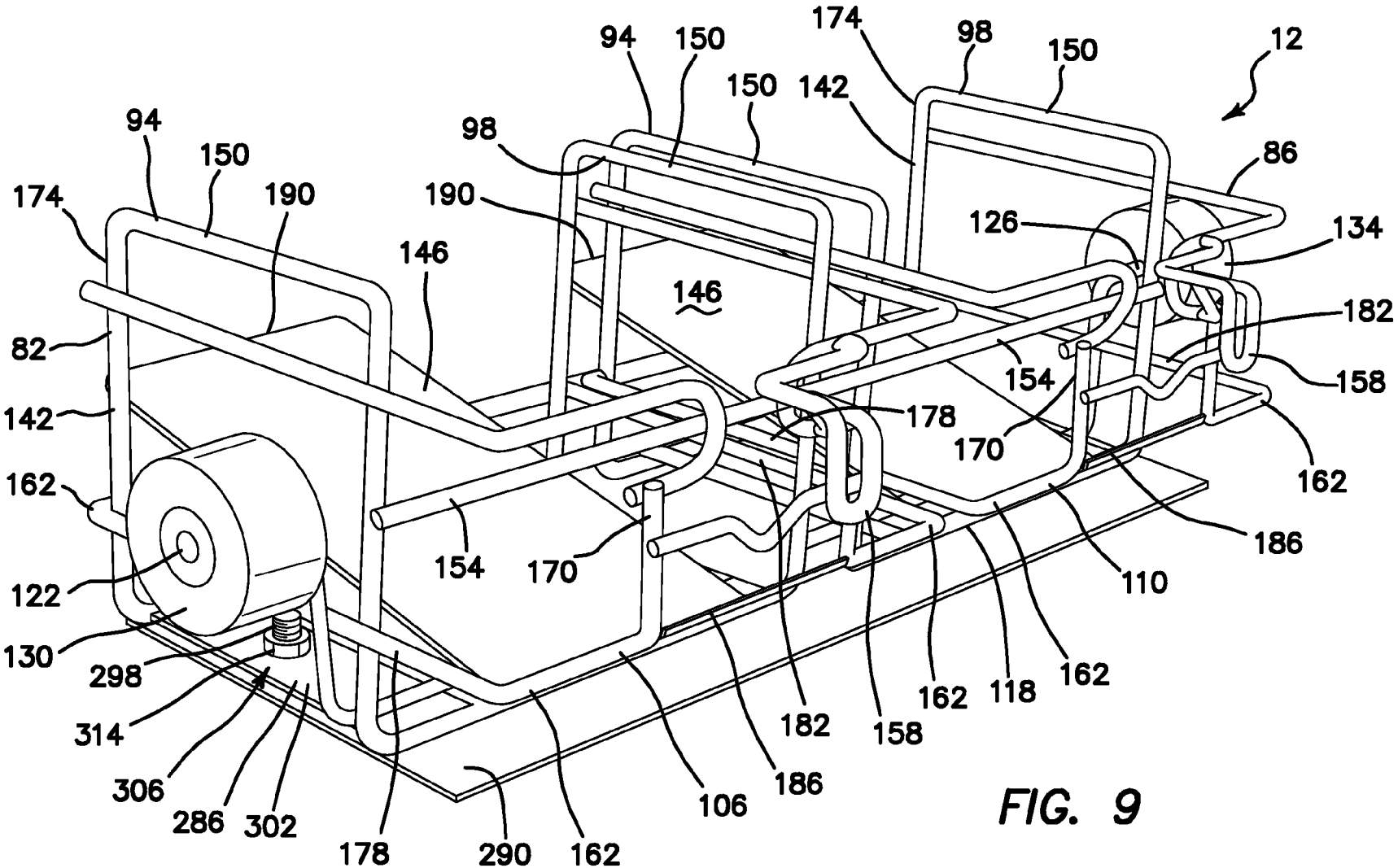
FIG. 9 is a perspective view of a second embodiment of the adapter for a bin mounted to the loading tray.

As illustrated in FIGS. 7 and 9, the adapter 12 includes first 82 and second 86 bag dispensers for vertically folded roll mounted bags 90. Each of the dispensers 82, 86 has first 94 and second 98 side panels and mounting features 286 for attaching the dispensers 82, 86 to a horizontal surface 290. A loading tray 294 is provided. The loading tray 294 has a planar, horizontal surface 290 and at least two attachment points 298 for attaching the first 82 and second 86 dispensers to the surface 290. The tray 294 aligns the front edges 106, 110 and bottom edges 114, 118 of the dispensers 82, 86, locating the second side panel 98 of the first dispenser 82 adjacent the first side panel 94 of the second dispenser 86. A first axle 122 is provided. The first axle 122 is mounted to the loading tray 294 orthogonally adjacent the first side panel 94 of the first dispenser 82 and is spaced forwardly and outwardly from the first side panel 94. A second axle 126 is provided. The second axle 126 is mounted to the loading tray 294 orthogonally adjacent the second side panel 98 of the second dispenser 86 and is spaced forwardly and outwardly from the second side panel 98. First 130 and second 134 positioning wheels are provided. The positioning wheels 130, 134 are mounted to the first 122 and second 126 axles and located to slidably engage the first 66 and second 70 integral channels with the bottom edges 114, 118 of the dispensers 82, 86 located upon a lower portion 138 of the cylindrical wall 22 of the bin 14.

(14) In yet a further variant, each of the dispensers 82, 86 includes a frame 142. A lower bag roll support 146 is provided. A movement constraining element 150 is provided. A bag roll restrainer 154 is provided. A perforation parter 158 is provided. The frame 142 includes four corners 162, each of approximately 90 degrees, and includes a dispensing end 170, a back end 174, and two sides 178, 182. The lower bag roll support 146 includes a proximal end 186 and a distal end 190. The distal end 190 is attached to the back end 174 of the frame 142 and extends angularly downward from the distal end 190 toward the proximal end 186. The movement constraining element 150 is formed as the first 94 and second 98 side panels. The side panels 94, 98 are attached to the two sides 178, 182 of the frame 142. Adjacent to the proximal end 186 of the lower bag roll support 146 the bag roll restrainer 154 is attached to the side panels 94, 98 of the frame 142. The perforation parter 158 is located adjacent the proximal end 186.

(15) In another variant of the invention, each of the mounting features 286 for attaching the dispensers 82, 86 to a horizontal surface 290 further includes at least one horizontal plate 302, the plate 302 has an aperture 306, the aperture 306 is sized, shaped and located to engage one of the at least two attachment points 298 on the horizontal surface 290 of the loading tray 294.

(16) In still another variant, each of the at least two attachment points 298 for attaching the first 82 and second 86 dispensers to the surface 290 further includes a threaded shaft 310 and a mating nut 314.

(17) In yet another variant, the loading tray 294 further includes a mounting rod 318. The mounting rod 318 connects the first axle 122 to the second axle 126.

Figure 8:
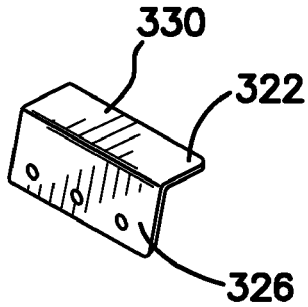
FIG. 8 is a perspective view of an L-shaped bracket for securing the loading tray to the cylindrical wall of the bin.

(18) In a further variant, as illustrated in FIG. 8, the adapter for a bin 12 further includes at least one L-shaped bracket 322. The bracket 322 has a vertical portion 326 and a horizontal portion 330 and is mounted by the vertical portion 326 to the lower edge 46 of the cylindrical wall 22 of the bin 14. The horizontal portion 330 is spaced above the cylindrical wall 22 to fit slidably over the horizontal surface 290 of the loading tray 294, thereby preventing excessive movement of the adapter 10.

(19) In still a further variant, as illustrated in FIGS. 5A and 5B, the adapter for a bin 12 further includes bags 90 for use in the dispensers 82, 86. The bags 90 include first 222 and second 226 parallel linear side edges, a top edge 230 and a bottom edge 234. The bags 90 are joined along a perforated severance line 238 at the top edge 230 of a first bag 246 and below the bottom edge 234 of a subsequent bag 250. The bags 90 are rolled about a horizontal axis 254 to form a bag roll 258 from which the bags 90 are dispensed. The bag roll 258 has a first predetermined width 262 narrower than a distance 266 between the side panels 94, 98, as shown in FIG. 3. When the bag roll 258 is located within the dispenser 82, 86 with the first bag 246 accessible for withdrawal from the dispenser 82, 86, the bags 90 may be serially withdrawn from the roll 258 with each subsequent bag 250 parted at the perforated severance line 238.

(20) In yet a further variant, as illustrated in FIG. 5A, the bags 90 further include a chisel cut 270. The chisel cut 270 penetrates the perforated severance line 238 and is located on it so as to align with the perforation parter 158 of the dispenser 82, 86.

(21) In another variant of the invention, as illustrated in FIG. 5B, the perforated severance line 238 is formed of a series of alternating cuts 274 and spaces 278. At least one of the cuts 274 is located so as to align with the perforation parter 158.

(22) In still another variant, as illustrated in FIG. 6, each of the bags 90 is folded along at least one axis 280 parallel to the first 222 and second 226 parallel linear side edges.

Figure 10D:
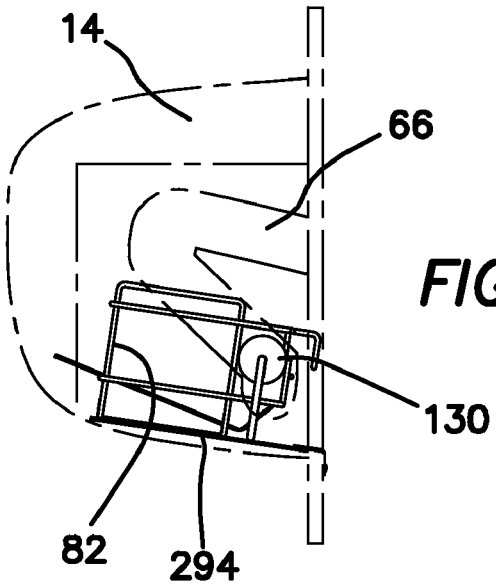
FIGS. 10A-10D are side elevational views of the FIG. 9 embodiment being loaded into the bin.
Figure 10A:
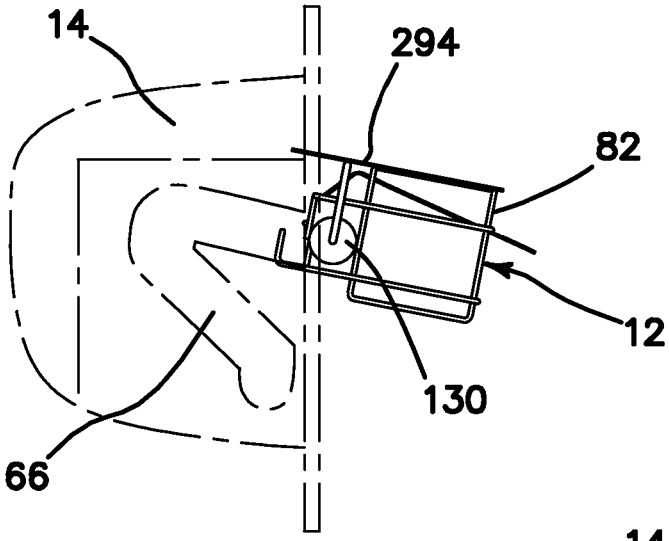
Figure 10B:
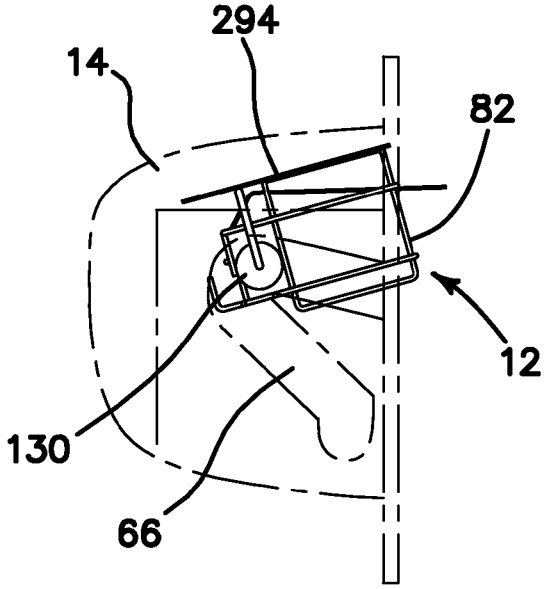
Figure 10C:
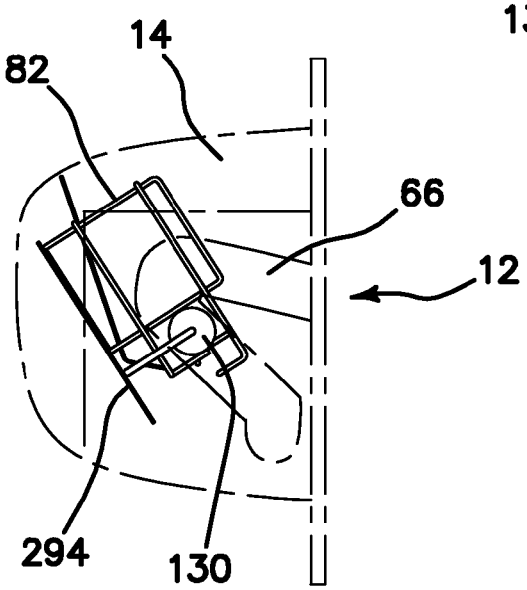

(23) In a final variant of the invention, a method of using an adapter for a bin 12, includes the steps of:

providing a support enclosure bin 14 for a roll of thermoplastic produce bags 18 that includes:

a half round cylindrical wall 22 and first 26 and second 30 vertical side walls;

a supporting rim 34, the rim 34 is located orthogonally to front edges 38 of the side walls 26, 30 and upper 42 and lower 46 edges of the cylindrical wall 22 and has spaced apertures 50 for mounting the bin 14 to a surface 54;

the surface 54 has an opening 58 sized and shaped to permit passage of outer surfaces 62 of the walls 22, 26, 30 but not the supporting rim 34;

the vertical side walls 26, 30 have first 66 and second 70 integral channels, the channels 66, 70 providing an entry point 74 and support for a rod 78, the rod 78 is sized and shaped to support the roll of produce bags 18 in the channels 66,70;

providing an adapter 10 that includes:

first 82 and second 86 bag dispensers for vertically folded roll mounted bags 90, each of the dispensers 82, 86 has first 94 and second 98 side panels and mounting features 286 for attaching the dispensers 82, 86 to a horizontal surface 290;

a loading tray 294, the loading tray 294 has a planar, horizontal surface 290, at least two attachment points 298 for attaching the first 82 and second 86 dispensers to the surface 290, aligning front 106, 110 edges and bottom edges 114, 118 of the dispensers 82, 86, locating the second side panel 98 of the first dispenser 82 adjacent the first side panel 94 of the second dispenser 86;

a first axle 122, the first axle 122 is mounted to the loading tray 294 orthogonally adjacent the first side panel 94 of the first dispenser 82 and is spaced forwardly and outwardly from the first side panel 94;

a second axle 126, the second axle 126 is mounted to the loading tray 294 orthogonally adjacent the second side panel 98 of the second dispenser 86 and is spaced forwardly and outwardly from the second side panel 98; and first 130 and second 134 positioning wheels, the positioning wheels 130, 134 are mounted to the first 122 and second 126 axles and located to slidably engage the first 66 and second 70 integral channels with the bottom edges 114, 118 of the dispensers 82, 86 located upon a lower portion 138 of the cylindrical wall 22 of the bin 14.

attaching the first 82 and second 86 dispensers to the loading tray 294, as illustrated in FIG. 9, using the mounting features 286 and the attachment points 298;

inverting the loading tray 294, as illustrated in FIG. 10A;

inserting the positioning wheels 130, 134 into the first 66 and second 70 integral channels in the bin 14, as illustrated in FIGS. 10B-10D;

positioning the loading tray 294 in the bin 14 with the first 82 and second 86 dispensers facing upwardly as illustrated in FIG. 10D;

securing the loading tray 294 to the lower edge 46 of the cylindrical wall 22 with at least one L-shaped bracket 322; and inserting a roll of bags 90 in at least one of the dispensers 82, 86.

The adapters for a bin 10 and 12 and method of using same has been described with reference to particular embodiments. Other modifications and enhancements can be made without departing from the spirit and scope of the claims that follow.

The invention claimed is:

1. An adapter for a bin, said bin comprising:

a support enclosure bin for a roll of thermoplastic produce bags, said bin having a half round cylindrical wall, first and second vertical side walls;

a supporting rim, said rim disposed orthogonally to front edges of said side walls and upper and lower edges of said cylindrical wall and having spaced apertures for mounting said bin to a surface;

said surface having an opening sized and shaped to permit passage of outer surfaces of said walls but not said supporting rim;

said vertical side walls having first and second integral channels, said channels providing an entry point and support for a rod, said rod being sized and shaped to support said roll of produce bags in said channels;

said adapter comprising:

first and second bag dispensers for vertically folded roll mounted bags, each of said dispensers having first and second side panels and mounting features for attaching said dispensers to a horizontal surface;

a loading tray, said loading tray having an upper planar, horizontal surface, at least two attachment points for attaching said first and second dispensers to said upper surface, aligning front edges and bottom edges of said dispensers, disposing said second side panel of said first dispenser adjacent said first side panel of said second dispenser;

a first axle, said first axle being mounted to said loading tray orthogonally adjacent said first side panel of said first dispenser and being spaced forwardly and outwardly from said first side panel;

a second axle, said second axle being mounted to said loading tray orthogonally adjacent said second side panel of said second dispenser and being spaced forwardly and outwardly from said second side panel; and first and second positioning wheels, said positioning wheels being mounted to said first and second axles and disposed to slidably engage said first and second integral channels with said bottom edges of said dispensers disposed immediately adjacent a lower portion of said cylindrical wall of said bin.

2. The adapter for a bin, as described in claim 1, wherein each of said dispensers comprises:

a frame;

a lower bag roll support;

a movement constraining element;

a bag roll restrainer; and a perforation parter;

wherein said frame includes four corners each of approximately 90 degrees, and includes a dispensing end, a back end, and two sides;

said lower bag roll support includes a proximal end and a distal end, said distal end being attached to said back end of said frame and extending angularly downward from said distal end toward said proximal end;

said movement constraining element being formed as said first and second side panels, said side panels being attached to said two sides of said frame; and adjacent to said proximal end of said lower bag roll support said bag roll restrainer is attached to said side panels of said frame, said perforation parter is disposed adjacent said proximal end.

3. The adapter for a bin, as described in claim 1, wherein each of said mounting features for attaching said dispensers to a horizontal surface further comprises at least one horizontal plate, said plate having an aperture, said aperture being sized, shaped and disposed to engage one of said at least two attachment points on said horizontal surface of said loading tray.

4. The adapter for a bin, as described in claim 3, wherein each of said at least two attachment points for attaching said first and second dispensers to said surface further comprises a threaded shaft and a mating nut.

5. The adapter for a bin, as described in claim 1, wherein said loading tray further comprises a mounting rod, said mounting rod connecting said first axle to said second axle.

6. The adapter for a bin, as described in claim 1, further comprising at least one L-shaped bracket, said bracket having a vertical portion and a horizontal portion and being mounted by said vertical portion to said lower edge of said cylindrical wall of said bin, said horizontal portion being spaced above said cylindrical wall to fit slidably over said horizontal surface of said loading tray, thereby preventing excessive movement of said adapter.

7. The adapter for a bin, as described in claim 1, further comprising bags for use in said dispensers, said bags comprising:

first and second parallel linear side edges, a top edge and a bottom edge;

said bags being joined along a perforated severance line between said top edge of a first bag and below said bottom edge of a subsequent bag;

said bags being rolled about a horizontal axis to form a bag roll from which said bags are dispensed, said bag roll having a first predetermined width narrower than a distance between said side panels; and whereby, when said bag roll is disposed within said dispenser with said first bag being accessible for withdrawal from said dispenser, said bags may be serially withdrawn from said roll with each subsequent bag being parted at said perforated severance line.

8. The adapter for a bin, as described in claim 7, wherein said bags further comprise a chisel cut, said chisel cut penetrating said perforated severance line and being disposed thereon so as to align with said perforation parter of said dispenser.

9. The adapter for a bin, as described in claim 7, wherein said perforated severance line is formed of a series of alternating cuts and spaces, at least one of said cuts being disposed so as to align with said perforation parter.

10. The adapter for a bin, as described in claim 7, wherein each of said bags is folded along at least one axis parallel to said first and second parallel linear side edges.

* * * * *